United States Patent [19]

Richter

[11] Patent Number: 4,833,843

[45] Date of Patent: May 30, 1989

[54] VAULTED DOME STRUCTURE

[75] Inventor: Donald L. Richter, Rolling Hills Estate, Calif.

[73] Assignee: TEMCOR, Torrance, Calif.

[21] Appl. No.: 128,871

[22] Filed: Dec. 4, 1987

Related U.S. Application Data

[60] Continuation-in-part of Ser. No. 852,561, Apr. 16, 1986, Pat. No. 4,711,063, which is a division of Ser. No. 730,164, May 3, 1985, Pat. No. 4,611,442.

[51] Int. Cl.[4] ..... E04B 1/32

[52] U.S. Cl. ..... 52/81; 52/741

[58] Field of Search ..... 52/81, 80, 741

[56] References Cited

U.S. PATENT DOCUMENTS

| | | | |
|---|---|---|---|
| 2,093,836 | 9/1937 | Guyon | 52/81 |
| 2,361,540 | 10/1944 | Forbes | 52/81 |
| 2,736,072 | 2/1956 | Woods | 52/81 |
| 2,871,521 | 2/1959 | Messmore | 52/80 |
| 2,891,491 | 6/1959 | Richter | 52/81 |
| 3,203,144 | 8/1965 | Fuller | 52/81 |
| 3,838,703 | 10/1974 | Zeigler | 52/81 |
| 3,918,226 | 11/1975 | Naidus | 52/80 |
| 3,974,600 | 8/1976 | Pearce | 52/81 |
| 4,180,950 | 1/1980 | Foster | 52/81 |
| 4,611,442 | 9/1986 | Richter | 52/81 |

FOREIGN PATENT DOCUMENTS

| | | | |
|---|---|---|---|
| 2023497 | 11/1971 | Fed. Rep. of Germany | 52/81 |

*Primary Examiner*—Carl D. Friedman

*Attorney, Agent, or Firm*—Christie, Parker & Hale

[57] ABSTRACT

A dome is provided by first establishing a basic dome curvature over a space having a defined perimeter. The basic curvature is crossed by substantially geodesic lines which intersect at desired foundation points on the perimeter and inwardly of the perimeter to subdivide the basic curvature into diamond-shaped areas which cover the majority of the basic curvature. A structural module is provided for each area. Each module has its perimeter defined by an open structural frame and has a surface bounded by the frame which has curvature greater than the basic curvature in the area to which the module is related. The module curvature is defined by a subsidiary structural network carried by the module frame. The modules are connected to the foundation points and to each other in a selected sequence to define the overall dome. The process of connecting the modules to define the dome can be performed without substantial use of falsework under the dome.

48 Claims, 9 Drawing Sheets

21
22
23
15
25
10
11
13
10
17
20
14
14
12
20
19
24
27
26
26
75
75
24

75
76
11
13
10
14
12
4
8
2
7
3
1
5
9
6
27
76
75
76
26
75
76
27
27
27

VAULTED DOME STRUCTURE

CROSS REFERENCE TO RELATED APPLICATIONS

This application is, a continuation-in-part of application Ser. No. 06/852,561, filed Apr. 16, 1986 (now U.S. Pat. No. 4,711,063) which was filed as a division of application Ser. No. 06/730,164 filed May 3, 1985 and now U.S. Pat. No. 4,611,442.

FIELD OF THE INVENTION

This invention pertains to large clear span domes. More particularly, it pertains to a dome composed of a plurality of compoundly-curved four-sided diamond-shaped shell modules interconnected to form substantially the entirety of the desired dome.

BACKGROUND OF THE INVENTION

The cross-referenced applications describe a large clear-span dome structure capable of being erected over an existing athletic stadium to enclose the stadium. That dome structure is well suited for use where the perimeter of the space to be enclosed is roughly circular. It can be used where the distance across the dome is as much as 700 feet or more. It can be erected with minimal use, effectively no use, of supporting falsework such as shoring or scaffolding. Its construction involves the use of trusses which extend along intersecting geodesic lines across the dome to define a principal dome curvature which is subdivided by the trusses into a number of preferably triangular openings. Each triangular opening is closed by a minor dome assembly which is itself curved convex outwardly of the overall dome with a curvature which is substantially greater than the principal dome curvature. The result is a dome which is locally dimpled convex outwardly of the dome. The local curvatures of the minor dome assemblies cooperate with the trusses to carry, to foundations along the dome perimeter, in the skin of the dome and across the trusses to adjacent minor assemblies, rather than entirely via the trusses, substantial loads due to the weight of the minor dome assemblies and of loads applied to them. The spaces within the perimeters of the minor assemblies can be closed by subsidiary structural members which define the local curvatures and which subdivide those curvatures into triangular openings which are closed by suitable closure panels.

There are other possible situations where a domelike enclosure over a space is desired but a circularly or generally circular dome would not be well used. Examples are situations where the area to be covered is substantially longer in one direction than in a substantially perpendicular direction, or where the area has an outline which is decidedly other than about circular. Such situations can exist in theme parks, shopping malls, botanical gardens and the like. Therefore, a need exists for dome structures which can be used to advantage in these other applications where, ideally, the dome is essentially transparent or translucent so that the dome protects the enclosed space from adverse weather conditions, or enables the creation of a controlled interior environment, but otherwise lets in sunlight. In such instances, a desired objective is as light and as unobtrusive a dome structure as possible, yet one which is structurally adequate, aesthetically appealing and efficiently erected.

SUMMARY OF THE INVENTION

This invention addresses the need identified above. It does so by extension of certain of the principles explained in the referenced applications to a trussless dome useful to enclose or cover spaces having decidedly non-round perimeters, as well as spaces having round perimeters. It provides a dome which can be erected efficiently without need for extensive use of falsework. It provides a family of domes which are aesthetically attractive and structurally sound, which can be transparent or translucent, and which can be used to cover spaces of substantial width and indefinite length.

Generally speaking, in terms of structure, the invention provides a dome structure for enclosing a space of desired planform outline and which is adapted to be supported on foundations at intervals along the outline to provide a clear span covering over the space. The dome structure comprises a plurality of major dome modules which have substantially diamond-shaped quadrilateral plan shape. The modules are arranged for interconnection of adjacent ones thereof along opposing sides and for connection of selected ones of them to the foundations to define a dome basic curvature which is convex to the exterior of the dome structure. Each major module has along its perimeter four corners which need not lie in a common plane; upon placement of the module in a selected position in the dome, its corners occupy four spaced points in the dome basic curvature. The sides of each module are straight when the module is seen in plan view. Each side of a major module is defined by a corresponding part of a essentially rigid module frame. Within its frame, each module has compound curvature which is convex to an exterior side of the module; such curvature along each diagonal of the module is greater than the basic dome curvature in that portion of the basic curvature associated with the module when the module is placed in its selected position and interconnected with other modules to define the finished dome structure.

Preferably, the interior of each module frame is crossed by a plurality of subsidiary structural members which define a number of triangular openings. Those openings are closed by closure members which are secured in a weathertight manner to the structural members defining the openings. The closure members can be transparent or translucent panels of glass or plastic.

The dome structure can also include a plurality of minor dome modules which are generally triangular in plan shape. The minor modules can be connected to the foundations and to the major modules along the perimeter of the dome to further define the dome's basic curvature and to substantially close the dome along its edges. Except for their different plan shape from the major modules, the minor modules are similar to the major modules.

Upon interconnection of the major modules to define the overall dome structure, some of those modules' sides become aligned along geodesic lines which extend across the dome. The several frame side members which cooperate along those lines define arches across the dome. Some of the arches interconnect other similarly-defined arches to create a stable and structurally sound load-carrying network which is supported by the foundations.

Generally speaking, in terms of method, this invention provides a method for erecting a clear span dome over a space having a perimeter of selected configuration. The method comprises several steps. One step is that of establishing a basic dome curvature over the space, the basic curvature having a perimeter which is substantially coextensive with the dome perimeter. Another step is crossing the basic curvature with a network of intersecting, substantially geodesic lines which intersect on the perimeter and inwardly of the perimeter to define on the basic curvature a plurality of contiguous, substantially rhombicly-shaped areas; some of these areas have one corner at the perimeter and the balance of which are inward from the perimeter. Another step of the method is that of establishing, at each intersection of the geodesic lines on the perimeter, a foundation for carrying vertical and lateral loads. Still another step includes defining, for each said area defined by the geodesic lines, a dome module which has a rigid four-cornered, centrally-open frame; in each frame the corners are spatially disposed essentially identically to the spatial disposition of the corners of the corresponding area of the basic curvature. The central opening of each frame between its main edge members is subdivided by a network of secondary structural members which define a module local curvature which is substantially greater than the dome basic curvature in the corresponding area. A further step of the method includes connecting, in a selected sequence, those modules which correspond to areas having a corner at the dome perimeter to the corresponding foundations and to two other modules along two edge members thereof, and also connecting each of the remaining modules to four other modules along the edge members thereof. The result of this procedure is the definition over the space of a dome which overall has the established basic curvature but which locally has curvature substantially greater than the basic curvature. In the dome the frame edge members of the several modules are interconnected along lines which correspond to the geodesic lines for transfer to the foundation of loads due to the weight of the modules and of loads applied to them.

BRIEF DESCRIPTION OF THE DRAWINGS

The above-mentioned and other features and advantages of this invention are more fully set forth in the following description of a presently preferred embodiment of the invention, which description is presented with reference to the accompanying drawings wherein.

DESCRIPTION OF THE ILLUSTRATED EMBODIMENTS

Figure 1:
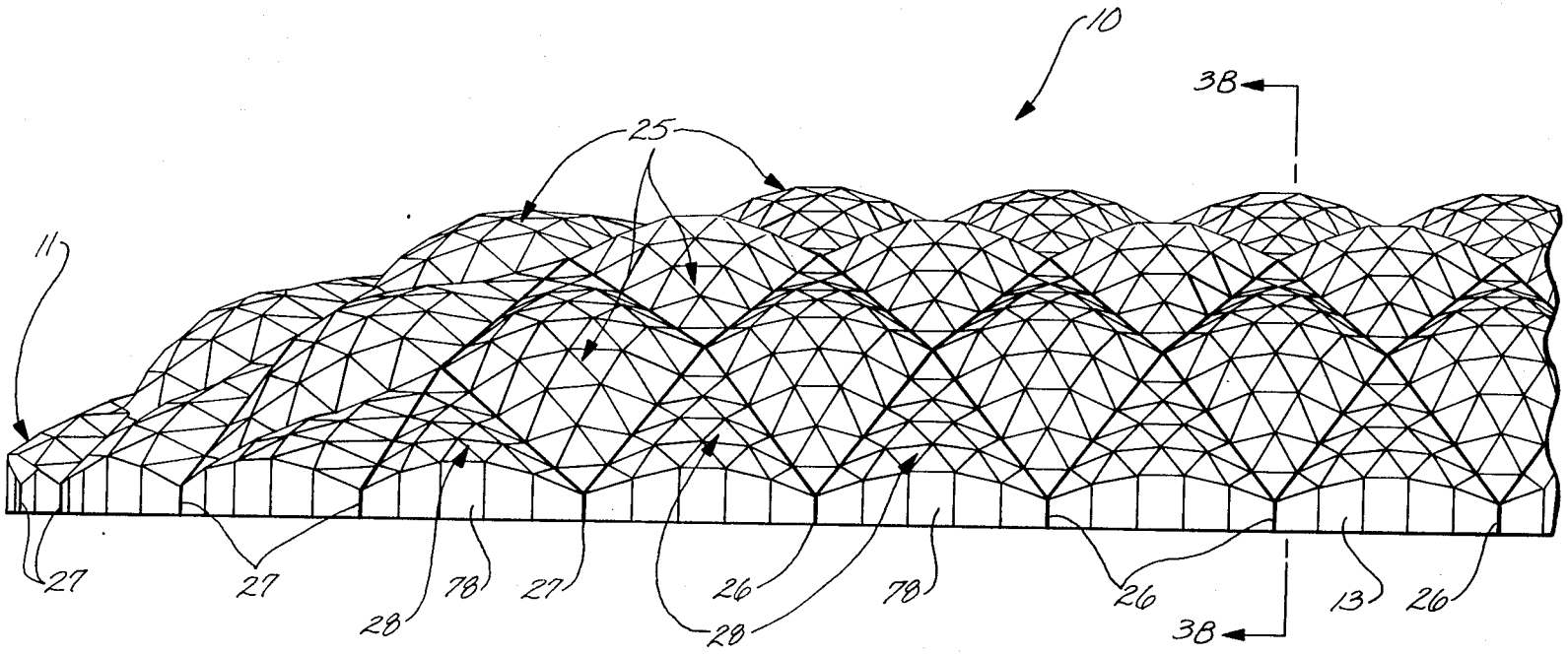
FIGS. 1 and 2 are, respectively, a side elevation view and a top plan view of one end of a dome of indefinite length, the other unillustrated end of which can be defined in the same manner as is shown in FIGS. 1 and 2.
Figure 2:
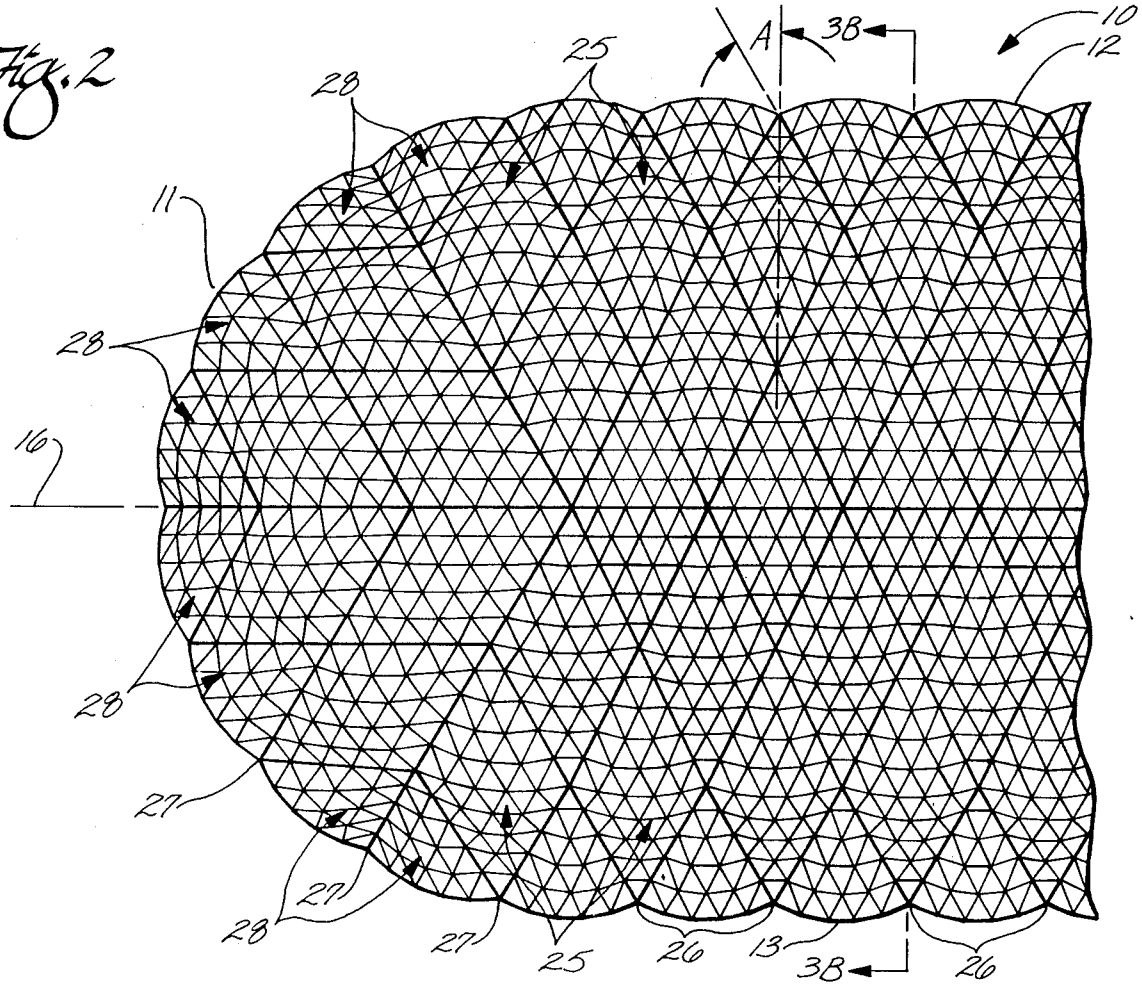

FIGS. 1 and 2 are respectively, a side elevation view and a top plan view of an end portion of a vaulted dome 10 according to this invention. The dome is of indefinite length from end 11 in that it can extend for any length desired along opposite, generally parallel sides 12 and 13 to an opposite end (not shown) which can, if desired, be a mirror image of the portion of the dome which is shown in FIGS. 1 and 2. Dome 10 preferably is a transparent dome in that it is glazed or skinned by transparent or translucent glass or plastic closure panels described more fully below with reference particularly to FIGS. 7 and 8. Dome 10 is disposed over a space which has an elongate oblong perimeter configuration in which the perimeter has generally straight sides 12 and 13 between preferably circular ends of the dome. The dome perimeter is locally scalloped convex outwardly of the dome at regular interval along its perimeter in the presently preferred embodiment of the invention which is shown in FIG. 2.

Figure 3:
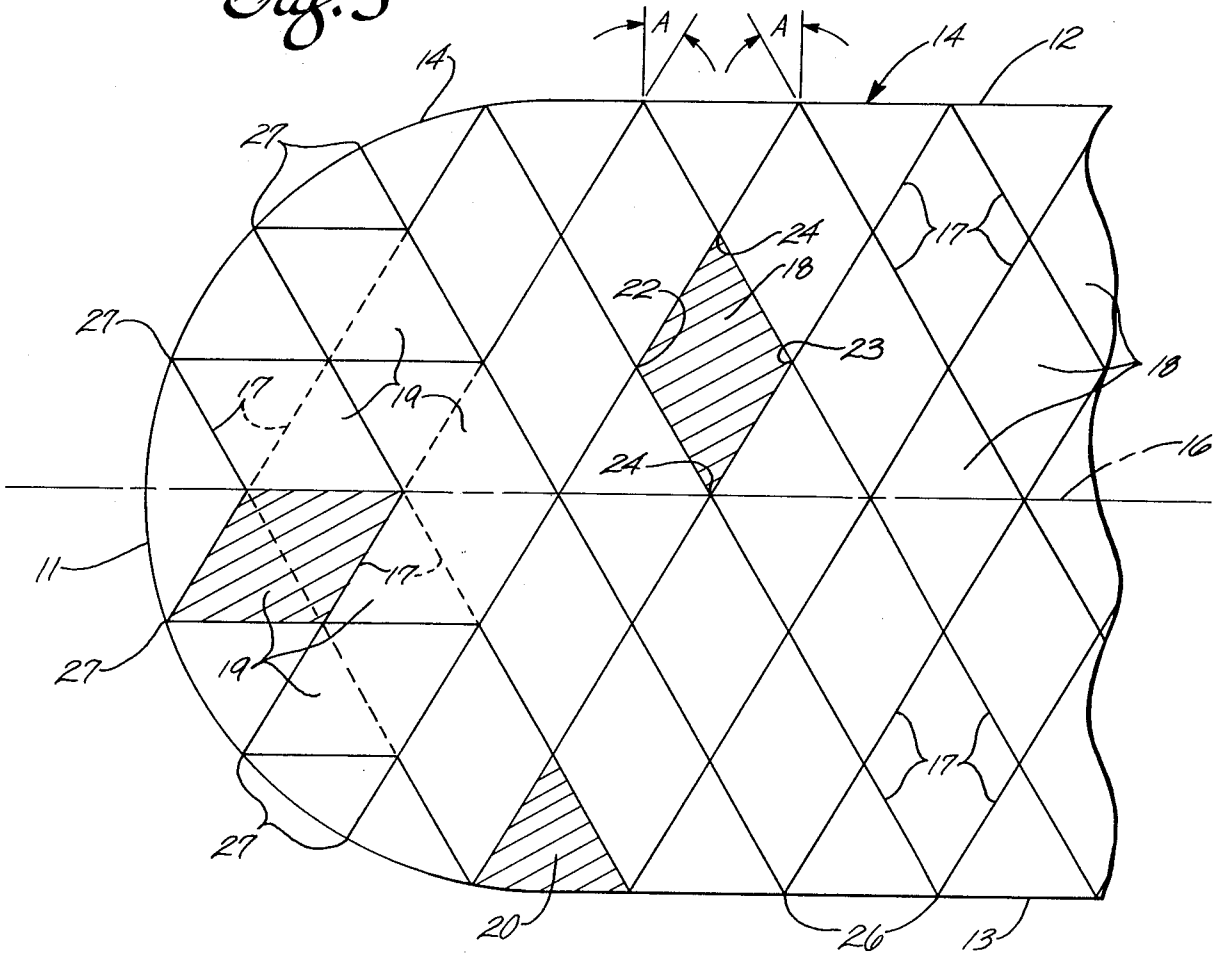
FIGS. 3A and 3B are simplified design-related diagrams presented to illustrate certain principles and concepts of this invention.
Figure 3B:
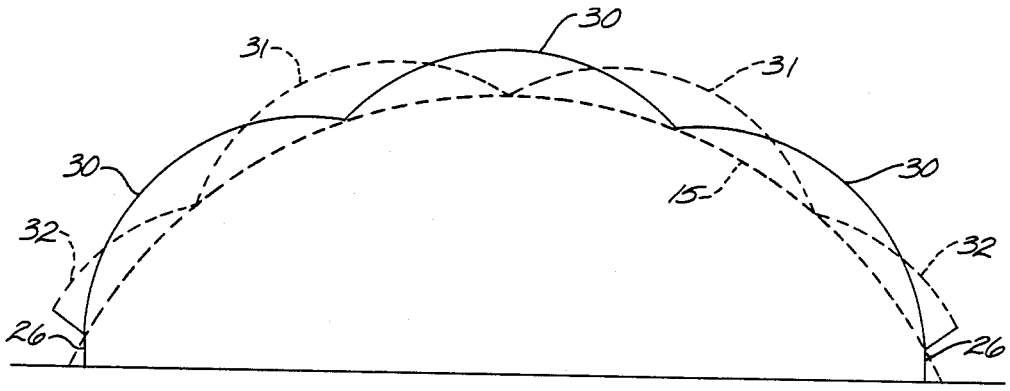

FIG. 3B is a diagraming simplification of cross-section view taken along line 3B—3B of FIG. 2. FIGS. 1, 2 and 3B collectively show that dome 10 has a basic curvature (represented by broken line 15 in FIG. 3B) which, between the generally parallel dome sides 12 and 13, is of cylindrical contour and which can be spherical or approximately spherical in contour at the end of the dome. These FIGS. also shown that the dome has local curvature, greater than that of the basic curvature, at each of a number of adjacent, generally diamond-shaped areas of the dome inwardly of its perimeter and also at each of a number of triangular smaller areas along the perimeter of the dome. The curvature of the dome exterior surface in each of these areas is a compound curvature which is greater than the underlying base curvature of the dome in corresponding directions. As a result, the exterior surface of the dome is locally dimpled convex outwardly of the dome; the curvature of each dimple is greater than that portion of the dome's basic curvature as defined generally by the lines along which the diamond-shaped and triangularly-shaped areas of the dome intersect each other. When viewed from inside the dome, the diamond-shaped and triangularly-shaped areas of the dome's surface are seen to be concave and so dome 10 can be called a vaulted dome.

An understanding of the principles of the structure of the dome and of its components, and of how the dome can be erected with minimal use of supporting falsework, likely will be assisted by an understanding of some of the concepts involved in the design of the dome. As shown in FIGS. 2 and 3A, dome 10 has a longitudinal centerline 16 which symmetrically bisects the perimetral outline of the dome midway between sides 12 and 13. The base curvature of the dome is first defined, preferably using centerline 16 as a principal baseline. Definition of the base curvature can be based upon a number of factors including the clear span height desired within the dome, structural requirements, and economic tradeoffs between higher or lower domes having relatively great or shallow base curvatures, among other factors. Once the base curvature of the dome has been established, a plurality of geodesic lines 17 are drawn across that base curvature from side to side of the perimeter; FIG. 3A is a diagrammatic simplification of this and related aspects of this part of a suggested and presently preferred dome design methodology. Geodesic lines 17 are drawn at an angle A to reference lines which extend across the width of the dome perpendicular to dome centerline 16. Angle A preferably is 30°. The geodesic lines preferably are drawn in two sets of such lines, one set of lines being inclined in one direction to the dome centerline and the other set being inclined in the opposite direction to the centerline. The lines in each set preferably are regularly spaced at equal intervals from each other; the spacing between adjacent lines in each set preferably is equal to the spacing between adjacent lines in the other set.

FIG. 3A shows that, between the parallel sides 12 and 13 of the dome perimeter, geodesic lines 17, define a plurality of diamond-shaped areas 18. One of these areas is shaded in FIG. 3A for emphasis. Each area 18 has the shape, substantially, of an equilateral rhombus or diamond having acute opposite included angles of preferably 60° and obtuse included opposite angles of preferably 120°; these preferred angle values are the values present when the outline of an area 18 is projected on a plane in which lie the ends of its major diagonal and to which the area's minor diagonal is parallel. It will be recalled that areas 18 actually are defined on the base curvature of the dome, rather than on a plane such as the floor of the dome. Thus, in three dimensions, the acute and obtuse angles of each area 18 are solid angles, not plane angles. It will also be observed that a group of essentially identical rhombicaly-shaped areas 19 can be defined in the vicinity of dome end 11 in positions inclined to centerline 16 to close off the preferably circularly curved end of the dome. Some of areas 18 and 19 have an acutely angled end lying on dome perimeter 14 at spaced locations 26 and 27, respectively, where the geodesic lines intersect the perimeter. In other words, FIG. 3A shows that a very substantial portion of the base curvature of the dome can be covered by a plurality of contiguous, substantially equilateral rhombuses, and that the balance of the area of the base curvature of the dome along the perimeter can be covered by substantially triangular areas 20, one of which is shaded. The triangular areas which lie along the opposite sides 12 and 13 of the perimeter preferably are equilateral triangles. It will also be apparent that the four corners 21, 22, 23 and 24 of each rhombic area 18 or 19 lie on the base curvature of the dome and so are not in a common plane with each other in this example which is of the presently preferred embodiment of the invention. That is, the four corners of each rhombic zone 18 and 19 lie on a portion of the dome base curvature which is concave to the interior of the dome. However, if in a different dome the base curvature has a flat portion, then the corners of a major module may have corners lying in a common plane.

Figure 4:
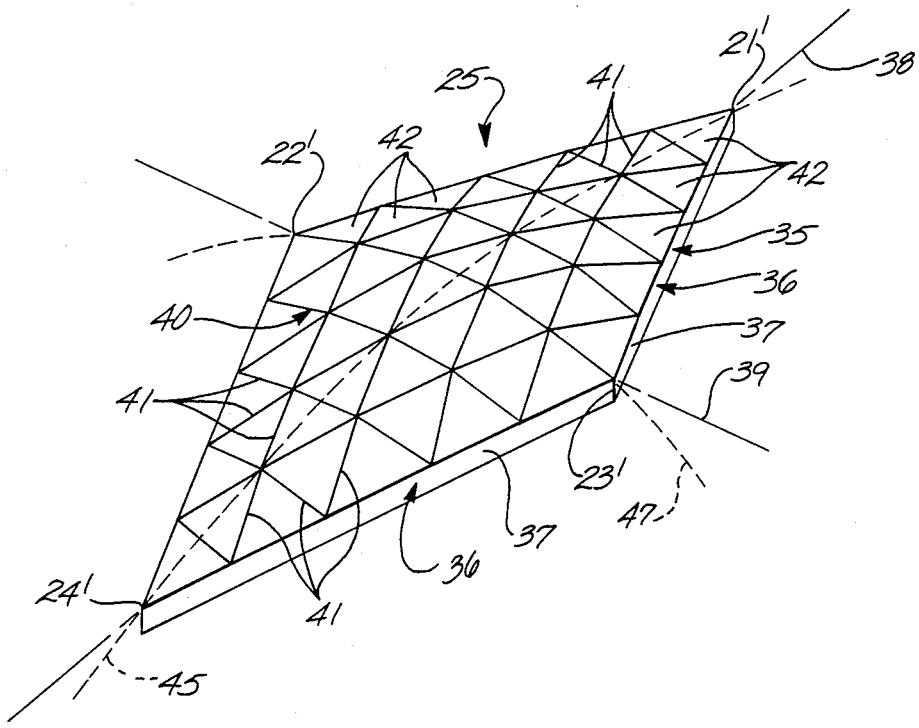
FIG. 4 is a perspective view taken, generally from above, of a major module of the dome shown in FIGS. 1 and 2, a number of such modules being used to define the principal aspects of the dome.

The subdivisibility of a substantial major part of the area of the dome base curvature into substantially similar rhombic zones enables the corresponding major portion of the structure of the dome to be defined by a plurality of rhombicaly-shaped four-cornered modules such as module 25 shown in FIG. 4, and for the balance of the structure of the dome along its perimeter to be defined by a plurality of triangularly shaped modules 28, most of which are substantially identical. The triangular modules are referred to as minor modules because they are smaller than, approximately half the size of, the rhombicaly shaped major modules. The major and minor modules can be prefabricated and interconnected in a selected sequence which makes it possible for most of the dome to be erected without the use of supporting falsework erected on the floor of the dome.

As will be seen from FIG. 3A, the points 26 at which one set of geodesic lines 17 intersect perimeter edges 12 and 13 are also points where different ones of the geodesic lines in the other set also intersect the perimeter edges. These points are established as foundation points at which corresponding ones of a plurality of foundations are provided along the dome perimeter for carrying vertical and transverse loads received from the actual dome structure and for carrying those loads to ground. Additional foundation points 27 are established at spaced locations along the curved end of the perimeter where different ones of the geodesic lines terminate. The additional foundation points are locations which correspond to the location of an acutely angled end of certain of the additional rhombicly shaped areas 19.

FIG. 3B illustrates additional principles of the design and structure of dome 10. FIG. 3B is taken along section line 3B—3B in FIGS. 1, 2 and 3A, which is in a vertical plane perpendicular to dome center line 16. In FIG. 3B, line 15 represents the base curvature of the dome as seen in the relevant section. Solid-line arcs 30, which have their end points lying on base curve 15 represent cross-sections along the major diagonals of the convexly outwardly curved major modules of the dome which lie along section line 3B—3B; dotted-line arcs 31 and 32 represent the exterior curvatures of the major modules and minor modules, respectively, which lie immediately behind those major modules represented by arcs 30. The end points of arcs 31 and the inner end points of arcs 32 also lie on the base curvature 15 of the dome. Lines 30, 31 and 32 taken together are suggestive of a truss. The equivalent of a truss is the structural effect achieved by the combination of the convexly outwardly curved major and minor modules (principally the major modules) represented by arcs 30, 31 and 32 shown in FIG. 3B. That is, the curvatures and structures of the modules which lie in the plane of section 3B—3B, and of the adjacent modules in front of and behind them and to which they are connected, cooperate to define the structural equivalent of a truss across the width of the dome in the plane of section 3B—3B. It will be apparent that section 3B—3B could be drawn at any one of a number of places transversely of the elongate extent of dome 10; this means that the several interconnected major modules of dome 10, all of which are convexly outwardly curved relative to the dome base curvature, cooperate to define the structural equivalent of a plurality of interconnected trusses or arches across the width of the dome. In this way, dome 10 is a self-trussed dome.

As will be made apparent from the following further descriptions of the major modules of the dome and of how they are interconnected to define the dome itself, the rigid edge members of the several major modules are disposed, for the most part, along geodesic lines 17 which extend between the various foundation points of the dome to define another variety of structural arch across the width of the dome in planes obliquely disposed to the length of the dome. These additional arches intersect each other to define a structural matrix for receiving and transferring to the dome's foundations loads due to the weight of the individual major modules and of loads applied to them. Because the arches defined by the interconnected edge members of the several major modules intersect each other, the result is a very strong and lightweight dome structure which is free of trusses per se.

Figure 5:
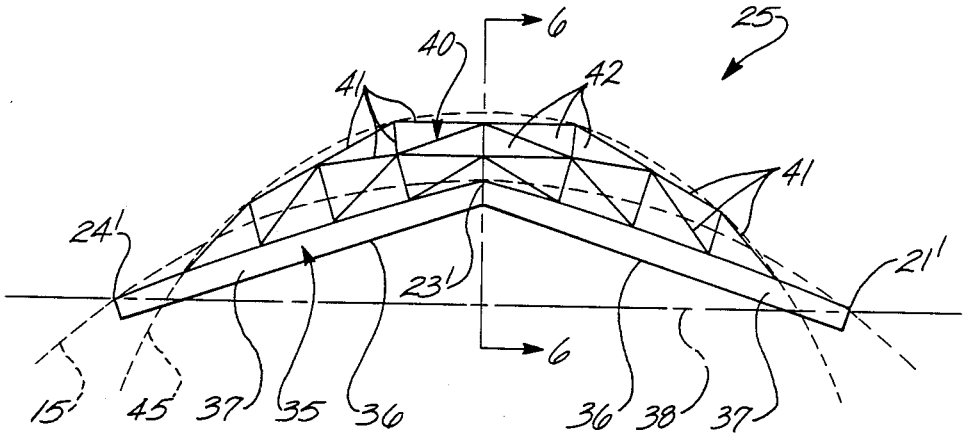
FIG. 5 is a side elevation view of the major dome module shown in FIG. 4.
Figure 6:
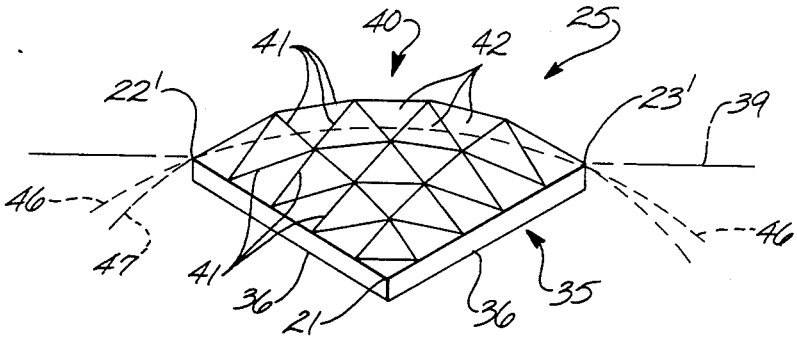
FIG. 6 is a section view taken along line 6—6 in FIG. 5.

FIGS. 4, 5, and 6 show a representative major module 25 of dome 10. If the base curvature of the dome between substantially straight opposite sides 12 and 13 of the dome is a circularly cylindrical curvature, then all of the major modules which lie entirely within the straightsided length of the dome are identical. If the base curvature of the dome between its straight sides is other than circularly cylindrical, say a parabolic cylinder, then the major modules which lie in this portion of the dome are similar but not identical to each other. In the same manner, the major modules which are used to define the curved end portion of the dome will be identical to each other if the base curvature of the dome in this portion is spherical, but they will be similar to each other and to the remaining major modules of the dome if the base curvature of the dome in its curved end portion is other than spherical. In any event, the principles of geometric and structural definition of the several major modules in dome 10 are the same, and so a description of one of these major modules will suffice as a description for all.

Figure 8:
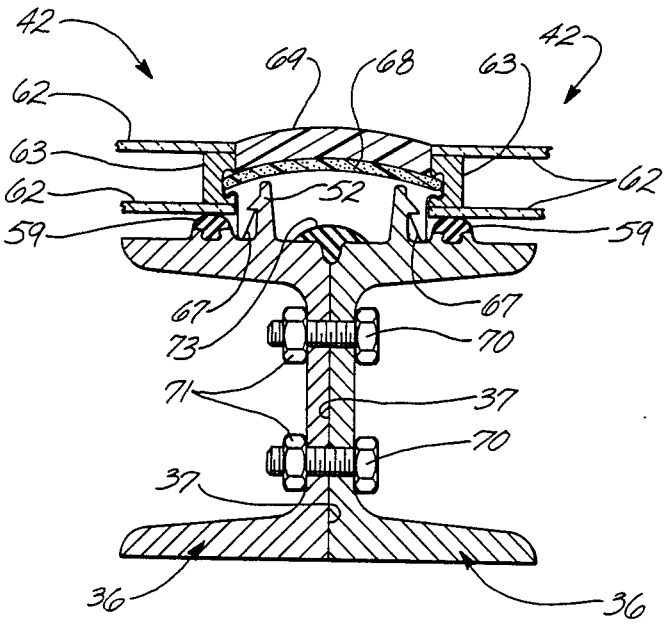
FIG. 8 is cross-sectional elevation view of the interconnection between juxtaposed major modules in the dome shown in FIGS. 1 and 2.

Major module 25, shown in FIG. 4, has an essentially rigid, structural frame 35 which is composed of four preferably straight structural members 36 of suitable cross-sectional configuration which are sized consistent with the loads that they are required to carry in the dome. Frame 35 preferably has flat exterior side faces 37. Therefore, a suitable cross-sectional configuration for each of frame edge members 36 can be a channel as shown in FIG. 8. The side (edge) faces of the module lie in respective planes which are parallel to a reference line which is common to all modules. Flat exterior surfaces of the frame of each dome module, both major and minor, parallel to a common line, are desired so that the exterior surfaces of the edge members of each module can be face-abutted to the exterior surface of an adjacent edge member of a contiguous module in the dome, and so that the face-abutted edge members of the different adjacent and contiguous modules can be bolted or otherwise conveniently secured together. Bolting is the preferred method for interconnecting adjacent modules in the course of erection of dome 10.

It is preferred that the edge members of each dome module be straight between the adjacent corners of the module. It is within the scope of this invention, that the edge members of a module can be curved between their opposite ends. In any event, the four edge members for each major module are substantially rigidly interconnected at the four corners of the module. The frame is a centrally-open structural assembly.

As shown in FIG. 4, module 25 has a major axis 38 which extends between the vertices of its acute included angles, and a minor axis 39 which extends between the vertices of the opposing obtuse included angles of the frame. The four corners 21', 22', 23' and 24' of the frame do not lie in a common plane because, as will be recalled from the preceding description, the four corners of the frame correspond to the locations 21, 22, 23 and 24 of intersecting geodesic lines 17 drawnacross the base curvature of dome 10 and that base curvature is not flat. Accordingly, module major diagonal 38 does not intersect the minor diagonal 39 of the same module.

As seen from FIGS. 4, 5 and 6, the interior of the perimeter frame of module 25 is spanned by a network 40 of intersecting secondary structural members 41 which are disposed to define the outwardly convex, compound curvature of module 25. The individual ones of secondary structural members 41 are connected to frame 35 and to each other within the frame to triangulate the local curvature of the module. That is, the several secondary members 21 are so interconnected to each other, as shown in FIGS. 4 through 6, to subdivide the local curvature of the module into a plurality of triangular, preferably substantially equilaterally triangular, areas bounded y the secondary members or by a combination of the secondary members and the module frame edge members. Where the secondary members intersect within the frame, suitable hub assemblies such as those shown in my prior U.S. Pat. Nos. 3,909,994 or 3,916,589, may be used to advantage to provide the requisite structural interconnections between members 41 and to facilitate closure of the triangular openings in weathertight manner by preferably flat closure panels 42. In the presently preferred dome according to this invention, closure panels 42 are transparent panels of glass or clear plastic, such as Abcite which is a surface-hardened Lucite sheet. Abcite and Lucite are trademarks of E. I. DuPont de Nemoirs and Co., Wilmington, Del., for acrylic resins in sheet and other forms The network 40 of secondary structural members 41 cooperates with module frame 35 to provide a dome module which can be of substantial size along its major and minor diagonals, which can accept and support substantial loads and can transmit those loads (including its own weight) to adjacent modules in the dome, such loads being carried to the foundations at the perimeter of the dome through the intersecting network of interconnected frame edge members 36. Network 40 also contributes to the rigidity of the module by, in effect, defining an intramodule truss within and connected to frame 35.

FIGS. 4, 5 and 6 also show how the curvature of each module 25 differs from the base curvature 15 of dome 10. In FIG. 5, broken line 15 represents the dome base curvature. It is seen that module corners 21'–24' all lie in the base curvature of the dome. Broken line 45 in FIGS. 4 and 5 represents the curvature of the module in a plane which includes the major diagonal 38 of the module. Curvature 45 is greater than base curvature 15. If module 25 is a module which in dome 10 will be associated with a base curve area 18, then the base curvature of the dome in the direction of the module's minor diagonal is a straight line. However, if the module is a module which is to be associated in the dome with one of areas 19, then the base curvature of the dome in the direction of the module's minor diagonal is a line which is curved concave away from the module, as represented in FIGS. 4 and 6 by arc 46. Regardless of whether the module is to be associated with an area 18 or an area 19 in dome 10, the actual curvature of the dome in directions parallel to its minor diagonal 39 is a curve 47 which has curvature greater than the dome base curvature in the same direction. The curvature of each module along lines parallel to its major diagonal is referred to as its major curvature, whereas the curvature of each module in directions parallel to its minor diagonal is referred to as its minor curvature. The major and minor curvatures of all modules 25 in dome 10 are preferably similar to each other.

Although not shown in detail in the accompanying drawings (but see FIGS. 1 and 2), dome 10 also includes a plurality of generally triangularly-shaped minor modules 28. Each minor module is structurally and geometrically similar to one-half of a major module, i.e., that half of a major module lying on either side of its minor diagonal. Thus, each minor module has two preferably straight, exteriorly-flat frame edge members 36 interconnected at a corner of the module which corresponds, for example, to corner 21' of module 25. The minor modules are not relied upon in dome 10 as major intermodule load-carrying constituents of the dome, but are used as closure assemblies to complete the structure of the dome along its perimeter. Obviously, each minor module must have sufficient structural integrity to be able to support its own weight and environmental loads such as wind or snow loads applied directly to it.

Figure 7:
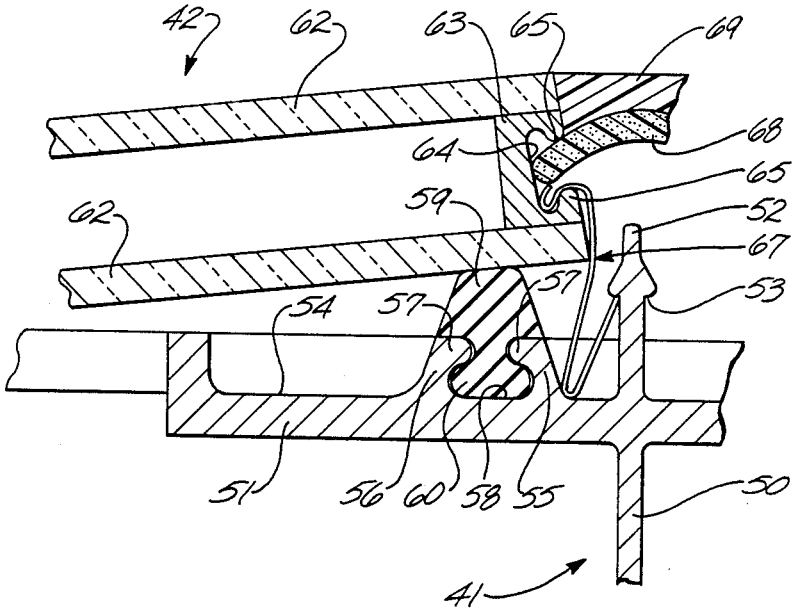
FIG. 7 is an enlarged, fragmentary cross-sectional elevational view of a preferred structure and methodology for mounting transparent or translucent closure panels to the structure of a major dome module.

Closure panels 42 can be secured in place in each module 25 or 28 to close the triangular openings defined in network 40 of that module in any convenient way which is effective to provide a watertight skin across the surface of the module within and along the edges of the open interior of the module frame. The panel mounting arrangements described and shown in my prior U.S. Pat. Nos. 3,477,752, 3,909,994, or 3,916,589 can be used if desired. However, the presently preferred manner of mounting closure panels 42 to module members 36 and 41 is as shown in FIGS. 7 and 8; this manner is particularly well suited for mounting glass or plastic transparent or translucent closure panels to the module in a weathertight manner. The closure panel mounting illustrated in FIGS. 7 and 8 is not itself a part of this invention, but is the subject of copending application Ser. No. 07/174,708, filed Mar. 29, 1988. Because the precise structures and procedures used to cover and seal the triangular openings defined by network 40 within the interior of each module 25 or 28 of dome 10 are the subject of a choice in the practice of the present invention, the presently preferred arrangements and procedures for accomplishing this objective, as shown in FIGS. 7 and 8, are described herein only with respect to their principal features. However, FIG. 7 does show that the preferred cross-sectional configuration of secondary structural members 41 of modules 25 and 28 is generally that of an I-beam, although a T-like section could also be used. Preferably, members 41 are extrusions which provide both the basic structural section of the member, as well as integrally therewith the principal features of the structure used to secure the closure panels to the members in a weathertight fashion.

In FIG. 7, the upper portion of a module secondary member 41 is shown with an edge portion of a closure panel 42. Preferably member 41 has a cross-sectional configuration resembling that of an I-beam and so has a central web 50 and an upper flange 51. A central rib 52 extends, preferably in the plane of web 50, from the upper surface of member 41. Below its upper end and on each of its opposite sides, rib 52 is contoured to provide a downwardly facing shoulder 53 in spaced relation to the upper surface 54 of flange 51. A shallow rib 55 extends from flange surface 54 on either side of the base of central rib 52 a short distance from that base. Rib 55 is located between rib 54 and a further shallow rib 56 which is spaced a short distance from rib 55 as shown in FIG. 7. Thus, although only one of each of ribs 54 and 55 is shown in FIG. 7, it will be understood that the upper surface of member 41 carries ribs 54 and 55 on each side of central rib 52. The upper extent of each of ribs 55 and 56 defines a lip 57 which extends toward the lip on the other of these two ribs. The lips do not abut each other and so define the opening to a recess 58 which opens to the upper side of member 41 through a constriction defined by lips 57. A resilient gasket member 59 is secured in recess 58 through the agency of a headed protrusion 60 on its lower extent, the protrusion being configured to cooperate relatively snugly within recess 58. Structural member 41 preferably is manufactured by an extrusion process so that ribs 52, 55 and 56 extend along the entire length of the member. Similarly, the gasket member 59 can be formed by an extrusion process and it, too, extends substantially along the entire length of the supporting secondary structural member. The upper extent of gasket member 59, as the gasket member received in recess 58, is disposed above the upper surface of flange 51 and preferably below the upper end of central rib 52.

As illustrated in FIG. 7, closure panel 42 can be defined by a pair of glass sheets 62 disposed in spaced parallel relation to each other and held in that relation by an edge member 63 bonded between the opposing faces of the glass sheets immediately inwardly of the edges of the sheets. Edge member 62 can be defined as a metal extrusion formed to have in its outer face a recess 64 having a constricted opening defined by a pair of spaced opposed lips 65.

Closure panels 42 are mounted to the network of structural members 41 by placing an individual closure panel across the opening that it is to close in such manner that the underside of the panel is supported substantially around its entire perimeter, just inwardly of its edge, on the upper extents of gasket members 52 carried by the sub-adjacent members 41. As so positioned, the edges of the closure members are disposed between the cooperating gasket members and the central rib 52 of the adjacent member 41. A plurality of spring clips 67 are engaged at suitable spaced locations along each edge of the closure panel between the closure panel and the adjacent member 41. As shown in FIG. 7, each clip 67 is configured at one end to be engaged over the lower lip 65 of the edge member 63 of the closure panel, and is configured at its other end to be engaged forcefully with the adjacent downwardly facing shoulder 53 on rib 52. Sufficient ones of clips 67 are engaged between each closure panel edge and the adjacent member 41 to provide the requisite hold-down force of the closure panel against gasket member 59. After both closure panels associated with a given structural member have been so placed in position and mechanically secured by the clips in that position, the space between them is closed. It is closed by engaging the opposite edges of a backing strip 68, preferably made of foam rubber or plastic, in the upper portions of the opposing panel edge member recesses 64 and then by applying a suitable quantity of a suitable flexible sealant 69 such as silicone rubber, over the top of backer 68. The sealant preferably is applied so that its upper surface forms a smooth bridge between the upper surfaces of the adjacent closure panels and bonds to the adjacent panel edges to provide a weather-tight seal between the adjacent panels along the lengths of their opposing edges.

Similar mounting arrangements, shown more in fully in the above-identified copending application, can be used adjacent the corners of each closure panel where the several secondary members 41 of each module's network 40 are interconnected by suitable structure.

FIG. 8 is a section view which shows the interconnection between the face-abutted frame member 36 of a pair of interconnected modules 25, 28 in dome 10. FIG. 8 also shows that in, the preferred practice of this invention, the upper portions of each frame edge member 36 define at appropriate locations a rib 52 and the other structural features to enable the closure panel mounting shown in FIG. 7 to be practiced with the frame edge members. FIG. 8 further shows that as dome 10 is defined by assembly of modules 25 and 28 in a desired sequence, the abutting edge members of adjacent modules are secured together by bolts 70 and nuts 71. If desired, a bead 73 of flexible gasketing or sealing material can be applied along the top of the interconnected frame edge members to seal the seam between abutted faces 37.

FIGS. 9 through 13 are simplified diagrams which illustrate a possible sequence of steps which may be performed to erect dome 10 on its foundations. The dome erection process preferably is commenced at an end 11 of the dome. The dome erection process preferably is carried out by first establishing the desired foundations at appropriate foundation locations 26 and 27 (see FIG. 3A). Dome modules 25 and 28 then are prefabricated in a desired sequence. Dome modules 25 are prefabricated at least through the stage of completion of their frames 35 and secondary member networks 40. If desired, the prefabrication of the modules can also include mounting some or all of closure panels 42 in place to close the triangular openings defined by the frame edge members and the secondary structural members of the module. If prefabrication of the several modules includes installation of the closure panels, it may be desirable to leave some of the closure panels along the frame edge members uninstalled to provide access through the top of the module to the frame edge member so that bolts and nuts 70 and 71 can be installed to secure mated modules together.

Figure 9:
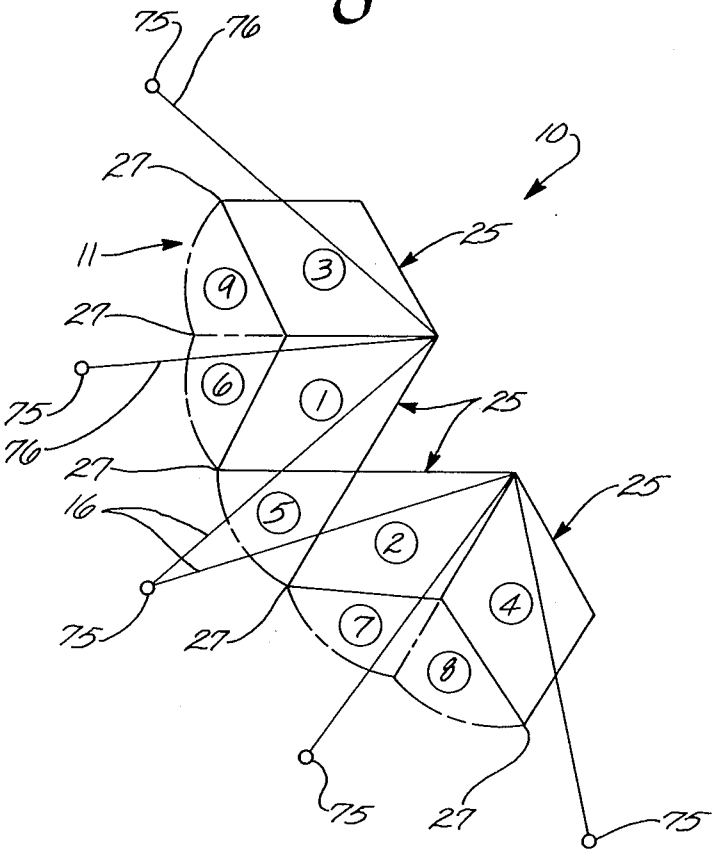
FIG. 9 is a diagrammatic plan view showing an initial stage of erection of the dome.

The dome erection process may be commenced at an end of the dome. A number of deadmen anchor positions 75 are established at selected locations outwardly of the end perimeter of the dome as shown in FIG. 9. A first major module 1 has the proper end of its frame secured to a foundation 27; its opposite end is secured by cables 76 to suitable deadmen 75 so that it is held in its desired position relative to the foundation. (In FIGS. 9–13, encircled numbers are associated with various ones of the major and minor modules there depicted to denote the sequence in which these modules may be put in place to define dome 10. Those encircled numbers in those FIGS. correspond to underlined numbers in this text.) A second major module 2 is similarly connected to its foundation and is stayed in its desired position by further tethers connected to suitable ones of the deadmen. Modules 1 and 2 are bolted together along their mated edges. Further major modules 3 and 4 then are connected to their foundation points and put into position adjacent the modules 1 and 2 respectively, are bolted to modules and are stayed, if needed, in those positions. If desired, appropriate ones 5 through 9 of the triangular minor modules may be connected to the pertinent foundations and to the major modules so placed, as shown in FIG. 9.

Figure 10:
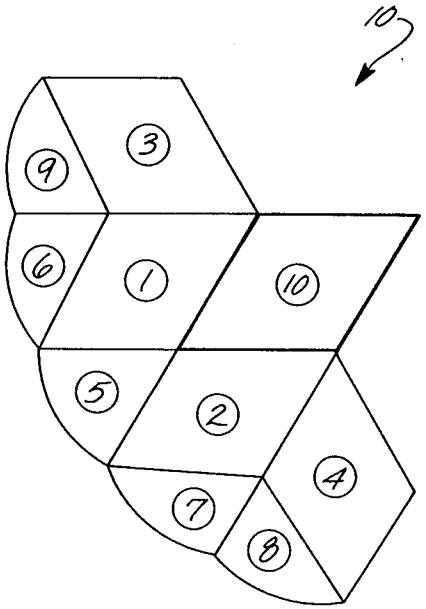
FIG. 10 is a view similar to that of FIG. 9 illustrating a subsequent stage of the dome erection process.
Figure 11:
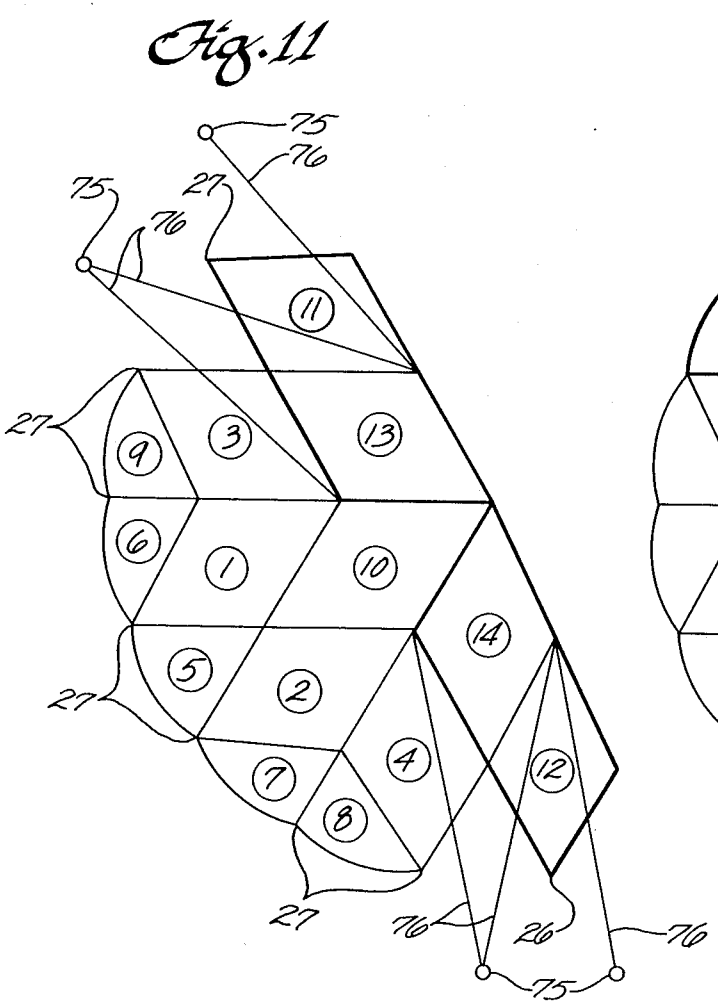
FIG. 11 illustrates a step of the dome erection procedure which may follow that shown in FIG. 10.
Figure 13:
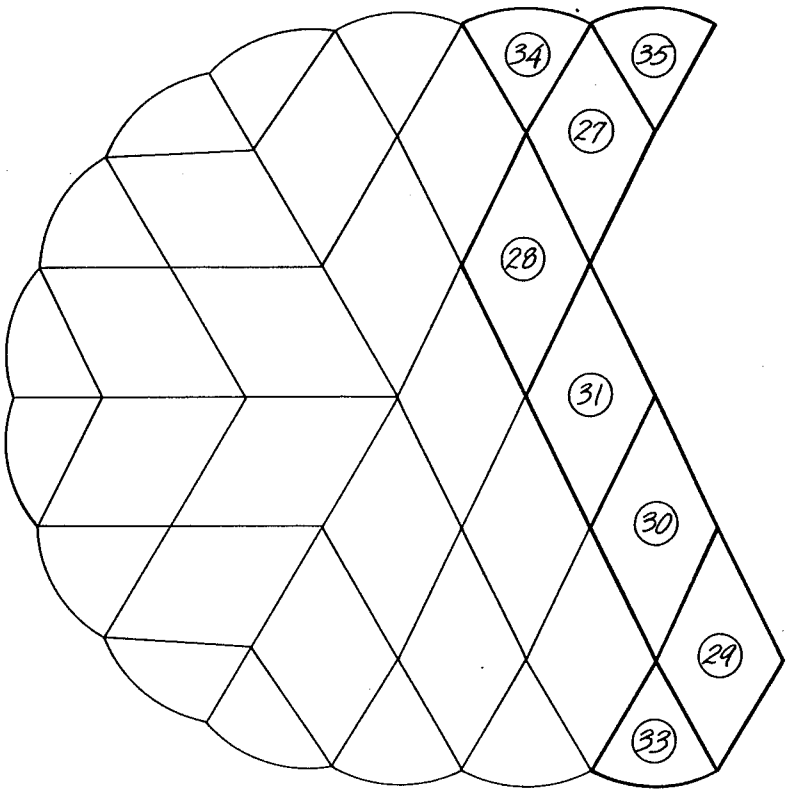
FIG. 13 illustrates still further erection steps which may be practiced following conclusion of the steps illustrated in FIG. 12.

Then, as shown in FIG. 10, another major module 10, of the dome can be moved into place and connected to both of modules 1 and 2. Preferably this is done while the previously placed modules are maintained in position by use of stays 76 and deadmen 75. A succeeding stage of the erection of dome 10 is shown in FIG. 11, which illustrates the placement of further major modules in place in the dome, namely, modules 11 through 14. Major modules 11 and 12 are connected to their foundation points adjacent to modules and are stayed in position by additional tethers 76 to appropriate ones of deadmen 75. Modules and modules and 12 contact each other only at their minor diagonal corners. Module 13 is then lifted in place between modules 3, 10 and 11 and is secured along three of its four sides to those adjacent modules; similarly, module 14 is placed between and connected along three of its sides to modules 10, 4 and 12.

Figure 12:
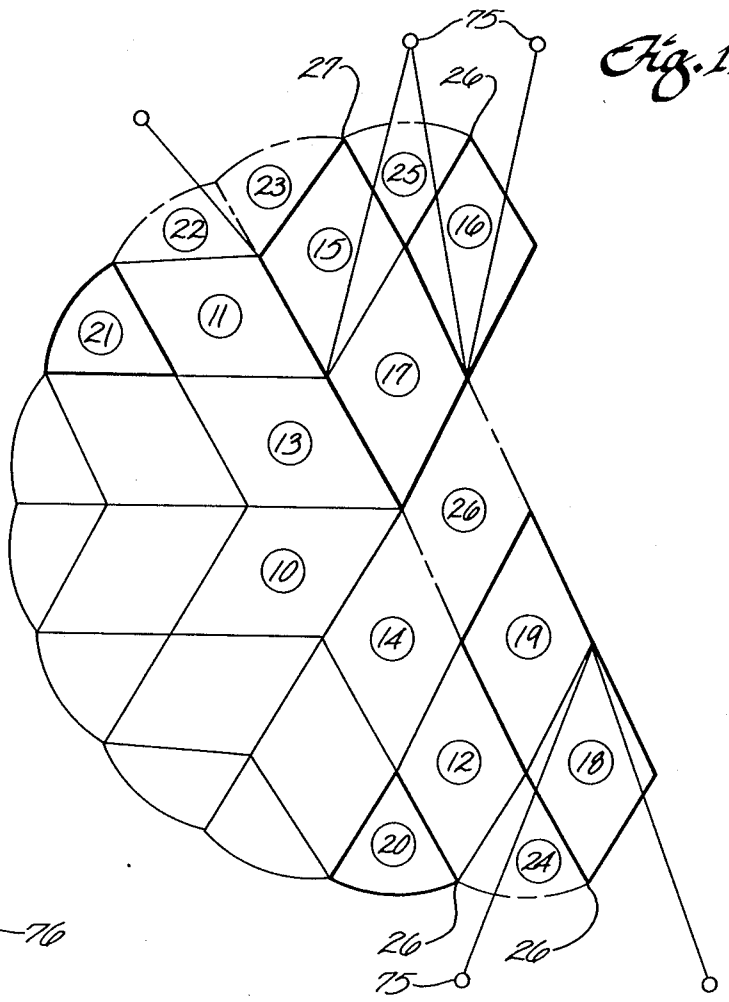
FIG. 12 illustrates dome erection steps which may follow the step illustrated in FIG. 11.

FIG. 12 shows a possible sequence by which further major modules can be connected along the perimeter of the dome as dome modules 15, 16 17, 18, 19 and 26 and by which additional minor modules can be installed along the perimeter of the dome as modules 21 through 25. Further use of deadmen and stays may be necessary. However, it is likely that at least by completion of the erection stage illustrated in FIG. 12, enough of the dome major module will have been put in place and interconnected that the partially assembled dome is sufficiently stable and strong that further ones of the essentially rigid major dome modules can be connected to those previously placed without further reliance upon deadmen and stays. Thus, the dome erection process can proceed quickly and efficiently in the manner shown in FIG. 13 until all of the major and minor modules in the dome have been placed and interconnected. Any closure panels 42 which have not been put in place during the module prefabrication operations can then be installed on the dome modules by personnel working entirely from the exterior of the dome.

The perimeter of dome 10 is then closed, if desired, by installation of walls 78, or of windows or access doorways as appropriate, in the vertical openings under the outer edges of the minor modules and between the foundations. Closure of the perimeter of the dome can be done either after the dome modules have been placed and interconnected, or during the process of placing and interconnecting the dome modules.

From the preceding descriptions pertinent to FIGS. 9 through 13, it is seen that dome 10 can be constructed by prefabrication of major and minor modules, and by placement and interconnection of those modules in a manner which enables the dome to be erected without the use of supporting scaffolding or other falsework in the interior of the dome. The elimination of internal supporting falsework represents a substantial saving in the cost of erection of the dome. The dome erection process can be completed by use of a relatively small number of mobile cranes on the dome floor and outside the dome.

It will also be appreciated that as the dome erection process progresses, the transverse self-trussed nature of the dome (See FIG. 3B) progressively develops so that, at an early stage of the process, the dome is sufficiently strong that additional modules can be put in place and connected to previously assembled modules to project in cantilevered fashion until additional modules are mated to them so that they are connected via these additional modules to the dome foundations. Also, as the dome erection process progresses, the network of arches along the dome's geodesic lines are developed and completed.

It will be seen from the preceding description that this invention provides a novel dome structure, and a novel method of erection of the dome, which is structurally efficient, economical, and esthetically appealing. The present invention, therefore, provides a new class of dome arrangements which can be used economically in a number of situations where the economics of known dome technologies are prohibitively costly. Workers skilled in the art to which this invention pertains will appreciate that the preceding descriptions and the accompanying illustrations are pertinent to a presently preferred embodiment of this invention. Such workers will appreciate that these descriptions and illustrations are not exhaustive of all forms which the invention may take, and that modifications and variations of the structures and procedures described can be pursued without departing from the spirit and true scope of this invention. Accordingly, the following claims are to be read in this context and are to be given the broadest construction and interpretation which is properly affordable to them by this invention and the place it occupies in the technology of domes.

What is claimed is:

1. A dome structure for enclosing a space of desired planform outline and which is adapted to be supported on foundations spaced at intervals along said outline and to provide a clear-span covering over the space, the dome structure comprising a plurality of dome major modules which have substantially diamond-shaped quadrilateral planform shape and which are arranged for interconnection of adjacent ones thereof along opposing sides and for connection of selected ones thereof to the foundations to collectively define a basic dome curvature which is convex away from the space, each major module having four corners along the perimeter thereof which, upon placement of the module in a selected position in the dome, occupy four spaced points in the dome basic curvature, each major module side being straight in a plan view of the module and being defined by a corresponding part of an essentially rigid module perimeter frame, each module within its frame having curvature convex to an exterior side of the module with such curvature along each diagonal of the module being greater than the basic dome curvature in a corresponding direction upon said placement and interconnection of the module to others of them to define the dome structure.

2. Apparatus according to claim 1 wherein, in each major module, each side thereof is defined by a module principal structural member which extends between adjacent corners of the module and is connected at each adjacent corner to another such member of the module.

3. Apparatus according to claim 2 wherein each module principal structural member is straight between opposite ends thereof.

4. Apparatus according to claim 2 wherein each side of each major module is defined by a substantially flat surface.

5. Apparatus according to claim 4 wherein the side surfaces of each major module are disposed in respective planes which are substantially parallel to a common line.

6. Apparatus according to claim 5 wherein said common line is a reference line common to all modules.

7. Apparatus according to claim 2 including means for connecting each module principal structural member to a similar member of a different module.

8. Apparatus according to claim 1 wherein each major module further comprises a plurality of subsidiary structural members interconnected to each other and to the frame and defining a network thereof across the interior of the frame, the network defining the curvature of the module.

9. Apparatus according to claim 8 wherein the subsidiary members divide the module curvature into a plurality of openings, and including closure means cooperating with the network for closing the openings.

10. Apparatus according to claim 9 wherein the openings are substantially triangular.

11. Apparatus according to claim 9 wherein the closure means are substantially flat.

12. Apparatus according to claim 9 wherein the closure means are translucent.

13. Apparatus according to claim 9 wherein the module subsidiary members define means for mounting the closure means thereto in a weathertight manner.

14. Apparatus according to claim 1 including a plurality of dome minor modules each of which is substantially triangular in plan shape.

15. Apparatus according to claim 14 wherein each minor module has two edges thereof which are straight in the plan shape of the minor module, such edges being defined by a pair of minor module principal structural members which extend between adjacent corners of the minor module and are connected to each other at one corner of the minor module.

16. Apparatus according to claim 15 wherein each minor module has curvature within its perimeter which is convex to an exterior side of the minor module.

17. Apparatus according to claim 15 wherein each minor module further comprises a plurality of subsidiary structural members interconnected to each other and to the minor module principal members and defining a network thereof across the interior of the minor module.

18. Apparatus according to claim 17 wherein the subsidiary members divide the area of the minor module into a plurality of openings, and including closure means for closing the openings.

19. Apparatus according to claim 18 wherein the openings are substantially triangular.

20. Apparatus according to claim 18 wherein the network defines a minor module curvature which is convex to an exterior side of the minor module.

21. A method of erecting a clear span dome over a space having a perimeter of selected configuration comprising the steps of:

a. establishing substantially coextensively with the dome perimeter and over the space a basic dome curvature, b. crossing the basic curvature with a network of substantially geodesic lines which intersect on the perimeter and inwardly thereof to define on the basic curvature a plurality of contiguous substantially rhombicly-shaped areas some of which have one corner at the perimeter and the balance of which are inward from the perimeter, c. establishing at each intersection of the geodesic lines with the perimeter a foundation for carrying vertical and lateral loads, d. defining for each said area a dome structural module which has a rigid four-cornered centrally-open frame in which the frame corners are spatially disposed essentially identically to the spatial disposition of the corners of the corresponding area of the basic curvature and in which the central opening of the frame between main edge members is subdivided by a network of secondary structural members defining a module local curvature which is substantially greater than the dome basic curvature in the corresponding area, and e. in a selected sequence, connecting those modules which correspond to areas having corners at the dome perimeter to the corresponding foundations and to two other modules along two edge members thereof, and connecting the remaining modules to four other modules along the edge members thereof, f. whereby there is defined a dome over the space which overall has the established basic curvature but which locally has curvature substantially greater than the basic curvature, and in which the frame edge members of the several modules are interconnected along lines which correspond to the geodesic lines for transfer to the foundations of loads due to the weight of the modules and of loads applied to them.

22. A method according to claim 21 wherein the step of crossing the basic curvature with substantially geodesic lines includes modifying the line pattern so generated so that the basic curvature is subdivided predominantly into said rhombicly-shaped areas in such manner that such areas contiguous to the dome perimeter have an acutely angled corner thereof substantially on the perimeter.

23. A method according to claim 21 wherein the dome perimeter is established to have substantially parallel opposite sides, and the crossing step is performed so that said lines which intersect the perimeter along such sides define points where a different one of such lines also intersects the perimeter, and the included angles between the lines intersecting at such points are acute angles.

24. A method according to claim 23 wherein said acute angles are substantially 60°.

25. A method according to claim 21 including defining for each area of the basic curvature which is not one of said rhombically-shaped areas a further dome module for covering the same by connection to at least one of said structural modules.

26. A method according to claim 25 including defining each further dome module with a local curvature over the area thereof which is curved convexly to an exterior surface of the module.

27. A method according to claim 26 wherein the local curvature of each further module is defined to be greater than the area of the dome basic curvature to which the further module corresponds.

28. A method according to claim 25 including connecting the further modules to the foundations and to the structural modules at selected places in said selected sequence.

29. A method according to claim 21 wherein the connecting step includes bolting the modules together along sides thereof.

30. A method according to claim 21 wherein each module is defined so that the network of secondary members thereof subdivides the module local curvature into a plurality of openings.

31. A method according to claim 30 including closing at least some of the openings in each module before using the module in performance of the connecting step of the method.

32. A method according to claim 21 including performing the connecting step without substantial use of falsework under the dome.

33. A method of erecting a clear span dome over a space having a perimeter of selected planform configuration comprising the steps of:

a. providing at spaced locations along the perimeter a plurality of foundations for carrying vertical and horizontal loads, b. providing, for each of a plurality of generally rhombicly-configured and four-sided contiguous portions of a basic curvature of the dome, a major dome module which has a structural perimetral frame having four corners and main structural edge members extending between adjacent corners and interconnected to each other at the corners, each module having its corners disposed at positions which correspond to the respective corner points of the respective portion of the dome basic curvature with which the module is associated, the module including a network of subsidiary structural members interconnected between the main edge members across the interior of the frame and subdividing the interior of the frame into a plurality of openings which are closable by closure panels connectible between the members of the module, the module as defined by the main and subsidiary members having curvature convex to an exterior side of the module which curvature is greater than the dome basic curvature over the portion thereof to which the module pertains, the module having a major diagonal between first nonadjacent corners and a minor diagonal between its other nonadjacent corners, c. connecting selected first ones of the modules at selected corners thereof to selected foundations in a selected portion of the dome perimeter and temporarily supporting the first modules so that at least one other adjacent corner of each first module is contiguous to similar other corners of others of the first modules, including interconnecting along juxtaposed frame edge members thereof any of the first ones of the modules which have two corners thereof contiguous to each other, d. interconnecting frame edge members of selected second ones of the modules to frame edge members of the first ones of the modules in such manner that a positionally stable portion of the dome is created which is self-supporting, such step being carried out so that at least some of the edge members of the interconnected modules lie substantially along intersecting substantially geodesic lines across the dome basic curvature which define said rhombicly-configured portions of the dome basic curvature, e. further connecting additional modules along the frame edge members thereof to available frame edge members of previously interconnected modules and to additional ones of the foundations in a selected sequence to enlarge the positionally stable portion of the dome, to extend said geodesic lines between foundations on substantially opposite locations on the dome perimeter, and to create portions of further geodesic lines, and f. continuing said further connecting step until, dependent on the location of a module in the dome, all of the major dome modules have been connected either to a foundation and to two other modules along frame edge members thereof or to four other modules along frame edge members thereof to define essentially the entirety of the dome basic curvature which is crossed by intersecting geodesic lines each terminating at foundations and wherein the dome in areas defined by such lines has local curvature greater than the subadjacent portions of the dome basic curvature.

34. A method according to claim 33 including performing the temporarily supporting portion of the connecting step from the exterior of the dome.

35. A method according to claim 33 including performing the connecting, interconnecting, and further connecting steps without substantial use of falsework.

36. A method of erecting a clear span dome over a space having a perimeter of selected configuration using a plurality of dome structural modules each of which has a rigid four-cornered centrally-open frame in which the frame corners spatially disposed out of a common plane and in which the central opening of the frame between main edge members is subdivided by a network of secondary structural members defining a module local curvature which is substantially curved along each diagonal of the module, the method comprising the steps of:

a. establishing at each of a plurality of spaced locations along the perimeter a foundation for carrying vertical and lateral loads, b. in a selected sequence, connecting selected ones of the modules to corresponding foundations and to two other modules along two edge members thereof, and connecting the remaining modules to four other modules along the edge members thereof, c. whereby there is defined over the space a dome which overall has a basic curvature but which locally has curvature substantially greater than the basic curvature, and in which the frame edge members of the several modules are interconnected along lines which extend between foundation locations and which correspond to geodesic lines across the basic curvature for transfer to the foundations of loads due to the weight of the modules and of loads applied to them.

37. A method according to claim 36 wherein the selected ones of the module are defined to have two acutely angled opposite corners, and including connecting an acutely angled corner of each selected one of the modules to a corresponding foundation.

38. A method according to claim 37 wherein the modules are geometrically similar to each other.

39. A method according to claim 36 wherein the selected ones of the modules have at least one acutely angled corner, and including connecting an acutely angled corner of each selected one of the modules to a corresponding foundation.

40. A method according to claim 36 wherein the modules have substantially diamond-shaped perimeter outlines.

41. A method according to claim 36 including connecting only one of the four-cornered modules to a foundation.

42. A method according to claim 36 including performing the connecting step without substantial use of falsework.

43. A dome structure for enclosing a space of desired planform outline and which is adapted to be supported on foundations spaced at intervals along said outline and to provide a clear-span covering over the space, the dome structure comprising a plurality of dome major modules which are arranged for direct interconnection of adjacent ones thereof along opposing sides and for connection of selected ones thereof to the foundations to collectively define a basic dome curvature which is convex away from the space, each major module side being defined by a corresponding part of an essentially rigid module perimeter frame, each major module having corners along the perimeter thereof which, upon placement of the module in a selected position in the dome, occupy respective spaced points in the dome basic curvature, each module within its frame having curvature convex to an exterior side of the module with such curvature in substantially orthogonal directions being greater than the basic dome curvature in corresponding directions upon said placement and direct interconnection of the module to others of them to define the dome structure.

44. Apparatus according to claim 43 wherein each side of each major module is substantially straight.

45. Apparatus according to claim 43 wherein each side of each major module connectible to another module in the dome structure is substantially flat.

46. Apparatus according to claim 43 wherein each major module comprises a network of structural members interconnected to each other and to the frame across the interior of the frame and defining the curvature of the major module, the network defining a plurality of openings, and closure means for closing the openings.

47. Apparatus according to claim 43 wherein each major module has four corners.

48. Apparatus according to claim 47 wherein the major modules are geometrically similar to each other.

* * * * *

UNITED STATES PATENT AND TRADEMARK OFFICE
CERTIFICATE OF CORRECTION

PATENT NO. : 4,833,843

DATED : May 30, 1989

INVENTOR(S) : Donald L. Richter

It is certified that error appears in the above-identified patent and that said Letters Patent is hereby corrected as shown below:

Col. 4, line 21, after "portion" insert -- 11 --; Col. 4, line 36, change "interval" to -- intervals --; Col. 4, line 39, change "diagraming" to -- diagrammatic --.

Col. 8, line 9, change "drawnacross" to -- drawn across --; Col. 8, line 25, change "y" to -- by --; Col. 8, line 39, after "forms" insert a period.

Col. 12, line 1, after "modules" insert -- 1 and 2 --; Col. 12, line 15, after "modules" insert -- 3 and 4 --; Col. 12, line 17, change "Modules and modules and 12" to -- Modules 3 and 11 and modules 4 and 12 --.

Signed and Sealed this

Eighth Day of May, 1990

*Attest:*

HARRY F. MANBECK, JR.

*Attesting Officer*

*Commissioner of Patents and Trademarks*